US006891479B1

(12) United States Patent
Eccleston

(10) Patent No.: US 6,891,479 B1
(45) Date of Patent: May 10, 2005

(54) REMOTELY CONTROLLABLE AUTOMATIC DOOR OPERATOR AND CLOSER

(76) Inventor: Jon E. Eccleston, 88 Los Cerros Ave., Walnut Creek, CA (US) 94598

( * ) Notice: Subject to any disclaimer, the term of this patent is extended or adjusted under 35 U.S.C. 154(b) by 145 days.

(21) Appl. No.: 10/461,663

(22) Filed: Jun. 12, 2003

(51) Int. Cl.[7] ..... G08B 21/00

(52) U.S. Cl. ..... 340/686.1; 340/545.1; 116/86; 49/13

(58) Field of Search ..... 340/686.1, 531, 340/532, 545.1, 545.2; 116/86; 49/13; 200/61.62

(56) References Cited

U.S. PATENT DOCUMENTS 5,050,346 A 9/1991 Eccleston
5,095,654 A 3/1992 Eccleston
5,878,530 A 3/1999 Eccleston et al.

OTHER PUBLICATIONS

*Doormaster—All Electric Light Duty Door Operator—Installation Instructions,* Date Unknown, pp. 1–16, Lanson Industries, Inc., Greendale, Wisconsin.

*Primary Examiner*—Jeffrey Hofsass
*Assistant Examiner*—Jennifer Stone
(74) *Attorney, Agent, or Firm*—Kenneth R. Graham

(57) ABSTRACT

A remotely controllable door operator apparatus is mountable to a doorframe structure and a movable door to control door movement between a closed position and an opened position. The operator apparatus includes a motor assembly, a linkage device, a slip clutch assembly, and a controller unit. The motor assembly has an output shaft, and the motor is mountable to one of the door and the door frame structure. The slip clutch assembly is coupled between the output shaft and the linkage device to transfer torque therebetween, and can slip to enable manual and remote operation of the door. The controller unit is coupled to the motor assembly to activate the operator apparatus to close the door in manual operation, and to open and to close the door in response to at least one remote signal. A method of using the remotely controllable automatic door operator and closer is also disclosed.

58 Claims, 6 Drawing Sheets

REMOTELY CONTROLLABLE AUTOMATIC DOOR OPERATOR AND CLOSER

BACKGROUND OF THE INVENTION

1. Field of the Invention

This invention relates, in general, to automatic door operators and more particularly to automatic door operators that may be operated manually and remotely.

2. Description of Related Art

Door opening devices are frequently found in commercial establishments such as airports, malls or supermarkets where manual operation of the door may be inconvenient to users. Understandably, handicapped individuals, including bedridden and wheel chair confined individuals, would greatly benefit from door opening devices in their homes and businesses. Unfortunately, however, many factors make it unfeasible for such individuals to benefit from door opening devices.

Many door operators are pneumatically, hydraulically, or electro-mechanically driven, and typically require substantial operating current and/or voltage. Installation of such an operator can include substantial modification to the door, the doorframe, and indeed the structure wherein the door and doorframe are mounted. Installation of such an operator frequently requires a building permit and the services of a skilled professional technician installer. As a result, "do-it-yourself" installation is generally precluded. The resultant cost of permits, equipment, and labor often prevents handicapped individuals from purchasing door operators for use at home and at work. In addition, conventional door operators often are expensive to maintain.

Different models of door opening devices and accessories are typically required based on whether the door is left-hinged or right-hinged, and/or whether the door swings inwardly or outwardly. Additionally, the installation may vary with each model, adding to the installation complexity.

Most door operators are large, bulky units that employ high torque, low rpm electric motors that require at least a minimal amount of gear reduction. Unfortunately, this combination is required because the device must be capable of being back-driven manually when not powered. Motors of this type are typically large when compared to high rpm motors of equivalent horsepower. Due to the large size of the magnets necessary to generate such a high torque at a low rpm, the motor and associated gear reduction mechanisms are relatively large. Often, these bulky door operators are too large to mount directly to the door and must be mounted on or above the door lintel. This may decrease the overall aesthetic appeal and, without substantial structural modification, may preclude installation and operation of the unit altogether. For example, in a retrofit installation where the upper portion or edge of the door is at or very near the ceiling, the amount of space provided between the door lintel and the ceiling may be insufficient to mount the unit.

Operators utilizing smaller high rpm motors achieve some reduction in size but must increase the ratio of gear reduction to bring about appropriate opening and closing speeds. This has an unfortunate result of substantially increasing the force required to manually move the door when the operator is not powered. This high mechanical resistance precludes the utilization of a spring to bring about the closing of the door. Thus, this type of operator must operate in the power mode at all times for all users due to the fact that the internal mechanisms are highly resistant to manual operation. A power outrage can render a door thus equipped into a frozen state potentially trapping people in hazardous situations. Typically, operators utilizing door closure spring mechanisms, which are often internally mounted, use low revving high torque motors, and close doors with internal spring mechanisms. Such a spring is compressed during the opening cycle. During the closing cycle, the spring force must be sufficient to close the door, while counteracting the resistance forces caused by the motor and counter-rotating the series of gears (the gear train) coupled to the electric motor. However, this spring force must not be so large as to prevent or substantially impair manual operation of the door, especially for physically impaired individuals. These opposing limitations often result in poor closing performance in windy conditions.

An unsuccessful electronic door opener that incorporated a slipping clutch to allow manual operation required a low rpm motor, a number of mechanical cams to switch the motor on and off. The slipping clutch was coupled to an output shaft of the door opener and thereby required a slipping clutch capable of transferring a substantial amount of torque. This configuration is difficult to install and adjust due in part to the utilized mechanical cams and overall size of the door opener. Ideally a slipping clutch could be utilized within a more compact door opener without requiring a large motor, mechanical cams, and a large slip clutch.

Moreover, with a power failure, an individual attempting to open or close the door may have to exert a substantial amount of manual force to overcome the resistance forces generated by the gear train, motor and/or internal or external door check spring. The magnitude of such resistance forces can exceed what a child, a frail or handicapped person can exert. As a result, such individuals may be trapped within a room whose exit includes an operator-equipped door that is frozen or inoperable to those individuals.

An exemplar of the prior art is U.S. Pat. No. 5,878,530 to Jon E. Eccleston et al., which is incorporated by reference herein, that shows a clutch assembly in an active mode during the powered opening, braking, holding and closing of the door and is in the passive mode the remainder of the time. This passive mode is an advantage on doors in a residential environment where a free moving non biased door is expected, and a door latch typically holds the door closed. Unfortunately, this passive mode is a problem when this door operator is used on doors without a door latch, as is common with store front doors and public bathroom doors. These types of doors are typically biased closed by a spring type door closer or door operator to resist wind without the use of an operated latch. In addition the general public is accustomed to encountering resistance when opening a public door manually.

What is needed is a door operator that overcomes the above and other disadvantages of known door openers. Ideally, such door operator should support both manual and automatic operation of the door. The door operator should be relatively compact and potentially substitutable for replacing a variety of door operators, such as, for example, a number of other installed door closers and/or door openers. The door operator should also be relatively easy to configure to support operation of left or right hinged doors and swinging in, out, or both ways. Operation of the door operator should also be remotely controlled, in part, to facilitate operating the door by handicapped and/or non-handicapped individuals. Further, the door operator should permit manual use of the door, such as, for example, in the event of a power interruption, malfunction, or an emergency. Ideally, the door operator should also be operable as a fire door closing device, and with or without a short interruption of operating electrical power. Further the door operator should be retrofitable.

BRIEF SUMMARY OF THE INVENTION

In summary, one aspect of the present invention is directed to a door operator apparatus mountable to a doorframe structure and a movable door to control door movement between a closed position and an opened position. The operator apparatus preferably is remotely controllable and typically includes a motor assembly, a linkage device, a slip clutch assembly, and a controller unit. The motor assembly preferably has an output shaft, with the motor mountable to one of the door and the doorframe structure. The linkage device is preferably mountable to the other of the door and the structure to control movement of the door. The slip clutch assembly is preferably coupled between the output shaft and the linkage device to transfer torque therebetween. The slip clutch assembly allows the clutch assembly to slip to enable manual operation of the door, and enables remote operation of the door otherwise. The controller unit is coupled to the motor assembly to activate the operator apparatus to close the door in manual operation, and to control remote operation of the door operator apparatus to open and to close the door in response to at least one remote signal.

The remotely controllable automatic door operator and closer of the present invention has other features and advantages which will be apparent from or are set forth in more detail in the accompanying drawings, which are incorporated in and form a part of this specification, and the following Detailed Description of the Invention, which together serve to explain the principles of the present invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
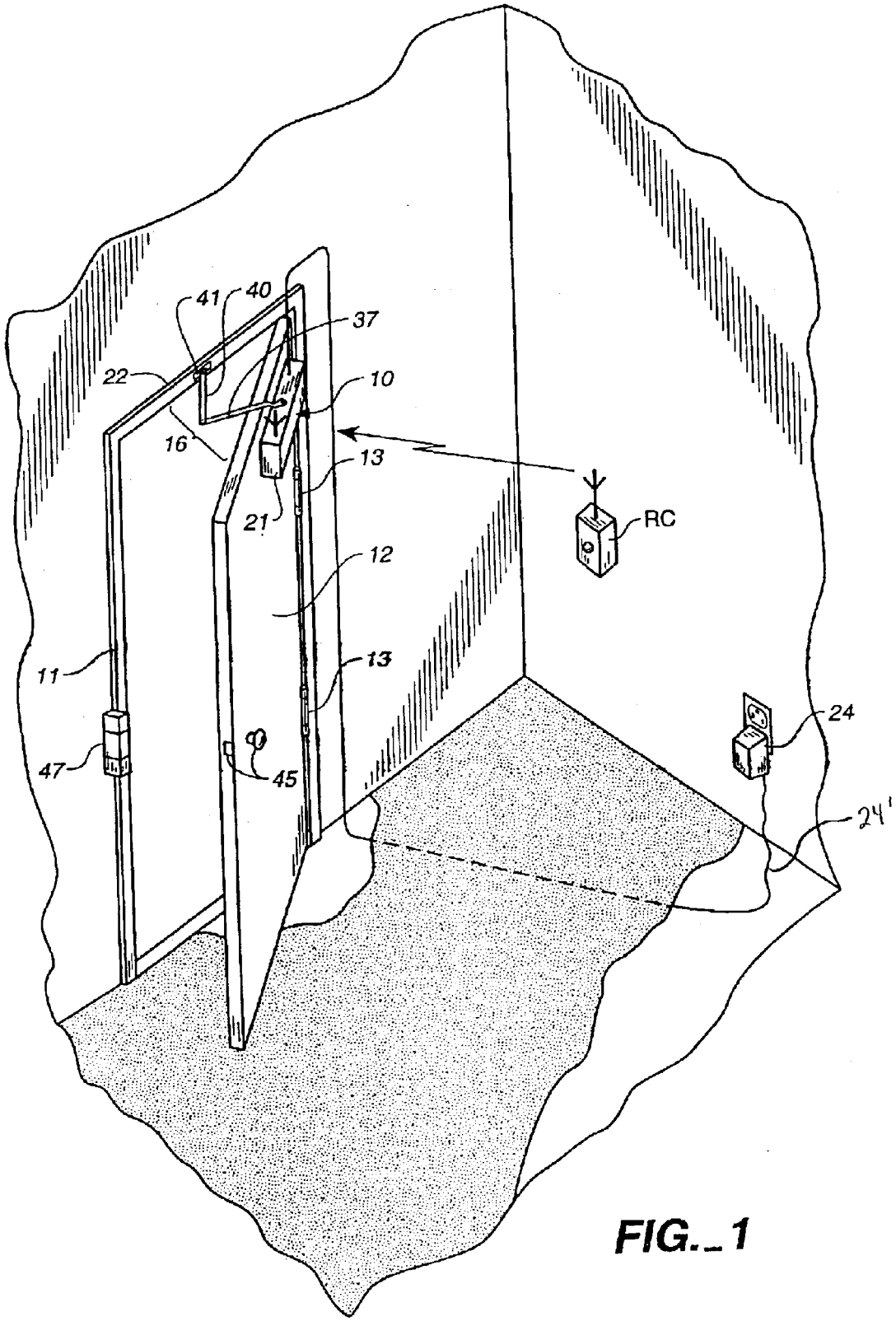
FIG. 1 is a fragmentary top perspective view of the door operator apparatus constructed in accordance with the present invention and mounted between a pivotal swinging door and a doorframe structure.
Figure 2:
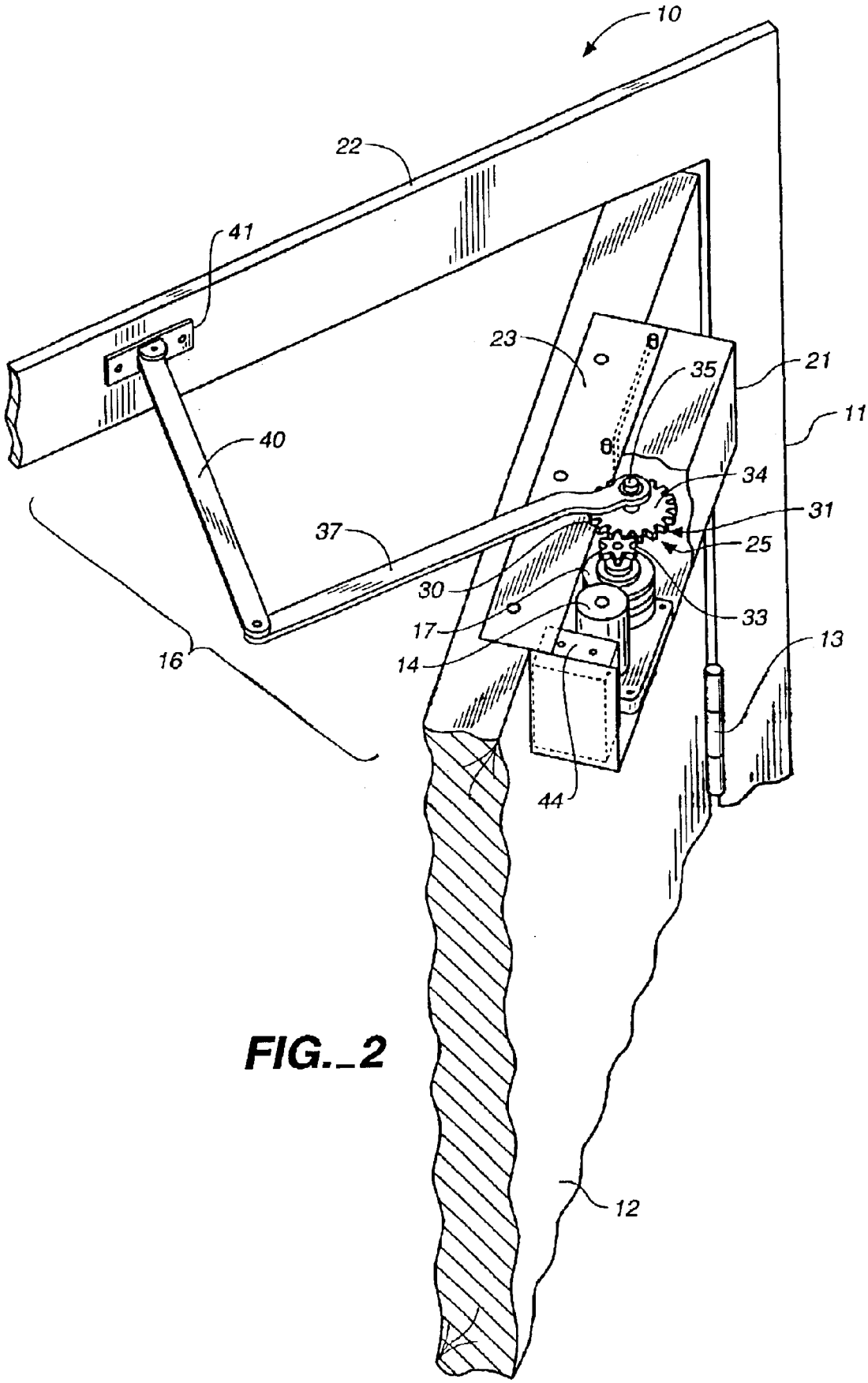
FIG. 2 is an enlarged, fragmentary top perspective view, partially broken away, of the door operator apparatus of FIG. 1, and having the housing mounted to the door.

Turning now to the drawings, wherein like components are designated by like reference numerals throughout the various figures, attention is directed to FIGS. 1–4 where a door operator apparatus, generally designated 10, is illustrated in a mounted position between a doorframe structure 11 and a door 12. The door 12 is movably coupled to the doorframe structure 11 with a door-coupling device 13, to support movement of the door between a closed position (FIG. 4) and an opened position (FIGS. 1 and 2). During the typically operation, door 12 is moved back and forth between the opened position and the closed position. The door operator apparatus 10 is mountable to doorframe structure 11 and movable door 12 to control movement of door 12.

Door operator apparatus 10 typically includes a motor assembly 14, a linkage device 16, a slip clutch assembly 17, and a controller 20. Motor assembly 14 is mountable to either the door 12 or the doorframe structure 11 to provide a first force to control movement of door 12. Linkage device 16 is mountable to the other of the door 12 and the doorframe structure 11 to control movement of the door 12. Slip clutch assembly 17 is coupled between the motor assembly 14 and the linkage device 16 to transfer at least a portion of the first force therebetween. Slip clutch assembly 17 allows the clutch assembly to slip to enable several modes of operation. Several modes of operation may be supported, such as, for example: a manual mode, an active manual mode, an active remote mode, and a combination thereof. Controller 20 is coupled to motor assembly 14 to activate and deactivate the motor assembly to operate the door in at least one direction, and may also be coupled to the motor assembly to sense the status of the motor assembly.

Linkage device 16 is mountable to the other of the door and the structure to control movement of the door. Linkage devices are well known in the art and are therefore not described in further detail herein.

Slip clutch assembly 17 is capable of transferring torque between an input clutch shaft 27 and an output clutch shaft 30. Typically, slip clutch assembly 17 transfers a predetermined maximum amount of torque between input clutch shaft 27 and output clutch shaft 30. Any torque in excess of the predetermined maximum amount is prevented by a slipping function of slip clutch assembly 17. Accordingly, the door 12 may be opened, closed, or moved with the application of a second force that is sufficient to overcome the predetermined maximum amount of torque that can be transferred between the clutch shaft 27 and the output clutch shaft 30. Advantageously, the door is operable in a wide variety of scenarios.

Slip clutch assembly 17 is designed to slip during the normal operation of the door 12. According to one embodiment, the slip clutch assembly may be a continuous slip clutch, commercially available from Polyclutch Division, Custom Products Corporation, of North Haven, Conn. Alternatively, the slip clutch assembly may be any of a variety of clutch assemblies that provide a slipping capability. Ideally, the slip clutch assembly 17 is adjustable to set or vary the maximum amount of torque that can be transferred between the input clutch shaft 27 and the output clutch shaft 30, in either one or both directions. Preferably, the controller 20 is capable of adjusting the maximum amount of torque that can be transferred by the slip clutch assembly 17, such as, for example, through the use and control of a mechanical or electrically device.

According to another embodiment, the slip clutch assembly may provide the characteristics of both a mechanical and an electromechanical clutch. The slip clutch assembly may include an electromechanical adjustment to vary the amount of torque that is transferred in one of either direction and/or both directions. Preferably, the amount of torque that is transferred is adjustable while the slip clutch assembly is in operation.

Controller 20 may also be coupled to motor assembly 14 to receive information that senses the operation and/or attempted operation of the door. The information received may identify an overload situation that may be indicative of an obstruction, or may identify movement of the door that may be indicative of a manual operation of the door.

Controller unit 20 is preferably configurable to operate under one or more modes, such as those described below. Each mode or set of modes may correspond to a set of possible events. A variety of inputs may be used to sense if an event has occurred. The controller may sense or determine if an event has occurred, and process the event, based on the current mode(s) of operation. For example, receiving a signal that would cause the door to open may not be processed in a manual only mode. Inputs may also be used, for example, to modify one or more mode of operation and/or to select the current modes of operation.

Figure 3:
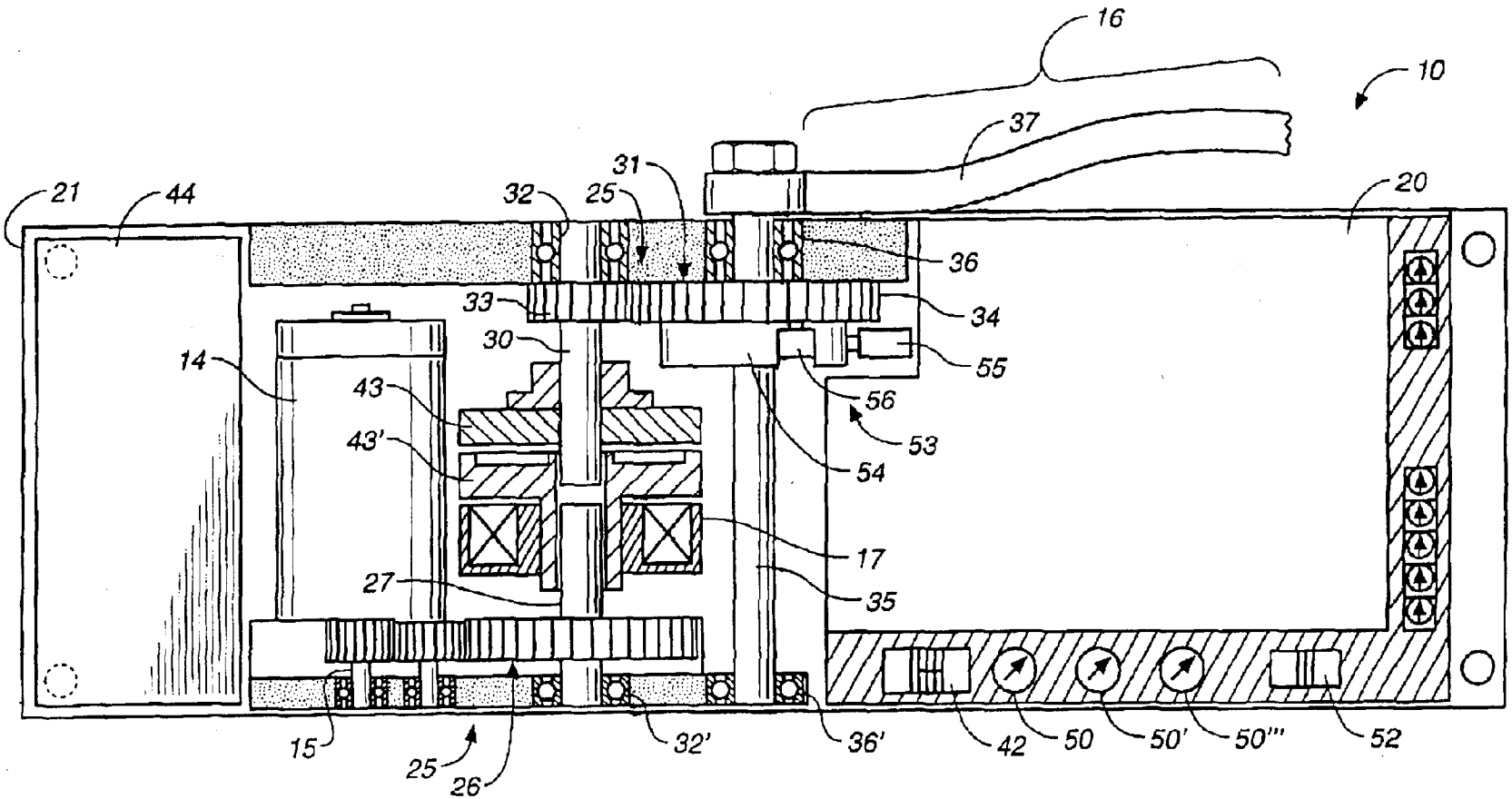
FIG. 3 is an enlarged, fragmentary side elevation view, in cross-section, of the housing of door operator apparatus, and illustrating the motor assembly and the clutch assembly.
Figure 4:
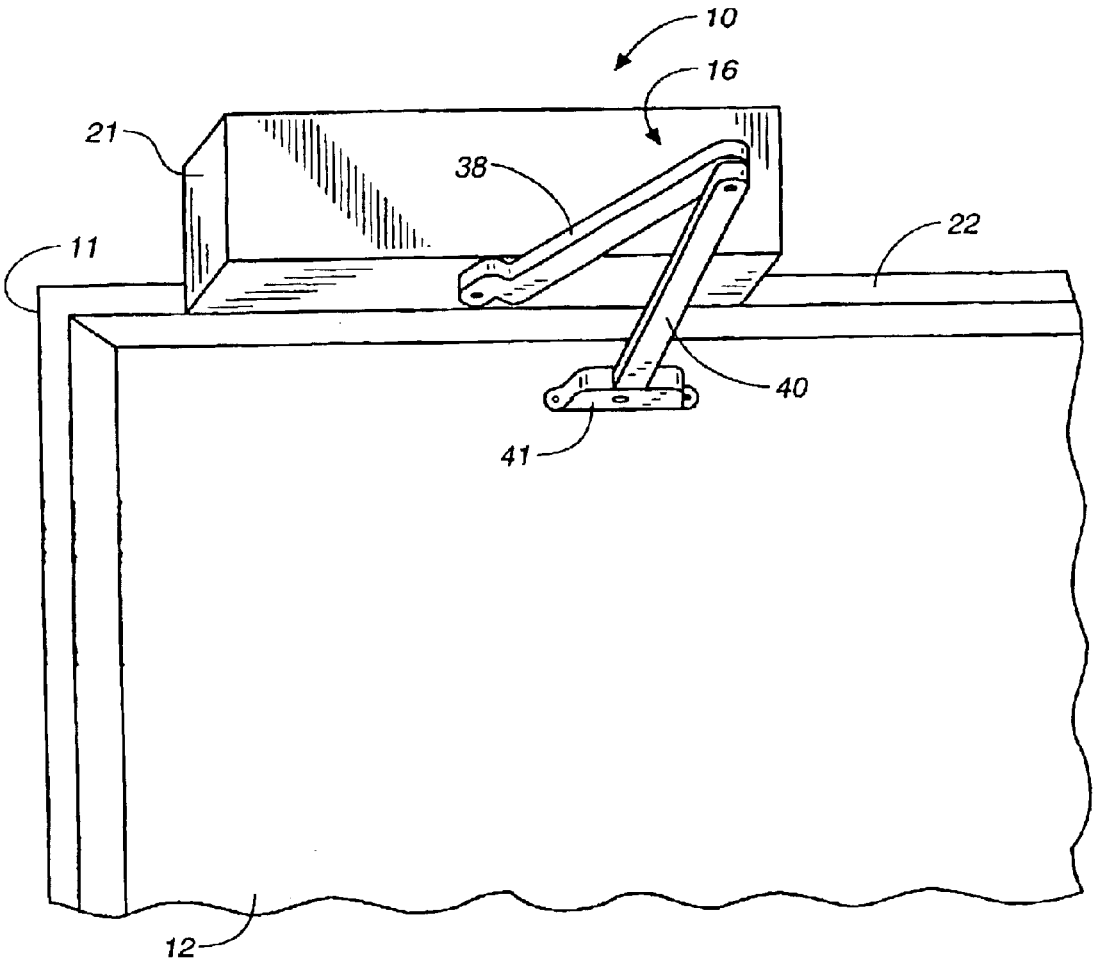
FIG. 4 is an enlarged, fragmentary bottom perspective view of the door operator apparatus of FIG. 1 having the housing mounted to the interior door lintel causing the door to open outwardly.
Figure 5:
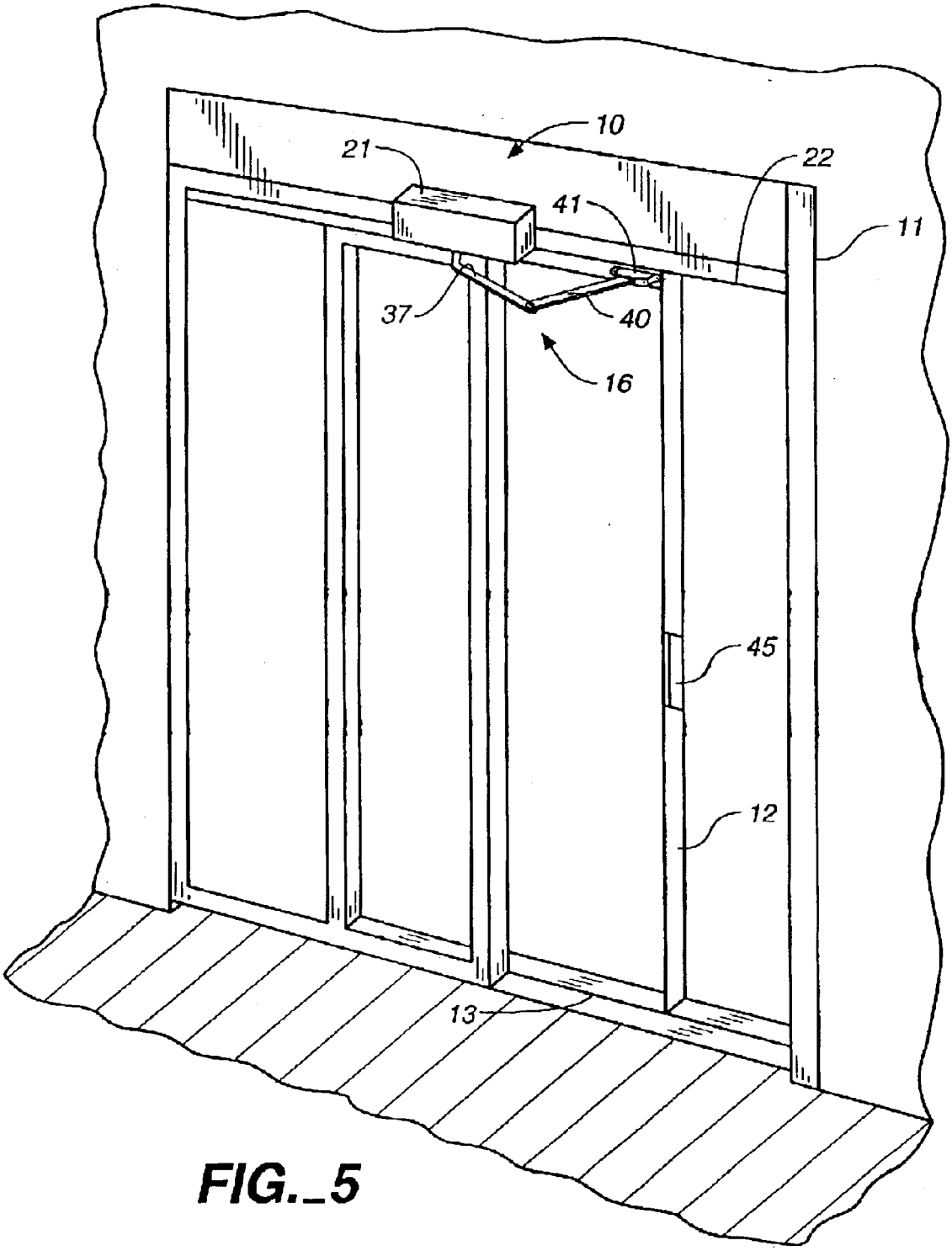
FIG. 5 is a fragmentary top perspective view of the door operator apparatus of FIG. 1 mounted to a sliding-type door.
Figure 6:
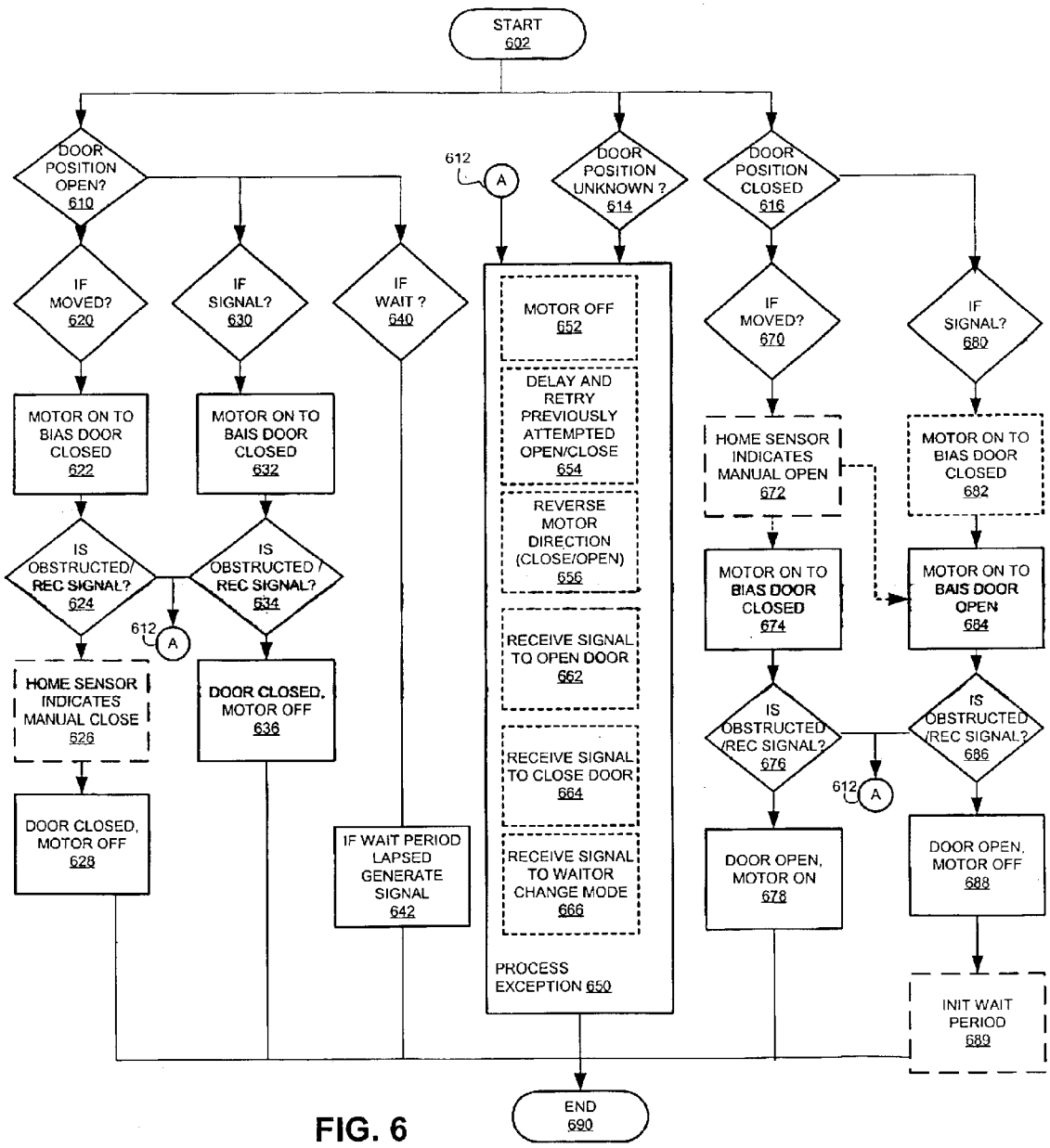
FIG. 6 is a flow diagram illustrating the method and operational features of the door operator assembly according to one embodiment.

FIGS. 2 and 3 illustrate motor assembly 14, clutch assembly 17 and controller unit 20 placed in a compact housing 21, which is similar to a conventional spring or hydraulically dampened closer that might be replaced by the door operator apparatus. The door operator apparatus may be mounted in a variety of positions, such as to either the door 12 (FIGS. 1 and 2) or the door lintel 22 (FIG. 4). Additionally, a single door operator unit can be adapted to accommodate a plurality of door configurations (such as, for example, right hinged or left hinged doors, and/or outward or inward swinging doors) without substantial modification. A single unit, hence, can be capable of a number of different mounting configurations. This added flexibility makes installation easier for a licensed technician or a self-installer, simplifies inventory, and can reduce the number of returns and exchanges. In contrast, the prior art door operators and openers often required an initial inspection of the door configuration before the selection of a door operator. Further, a door operator according to the present invention is readily retrofitable.

Depending upon whether the housing or cover of the door operator is mounted to the door or the door lintel, additional mounting brackets or plates could be provided. Preferably, door housing 21 includes a lip portion or mounting plate 23 (FIG. 2) which is adapted to mount the door operator to the top ledge of door 12 using a fastener, such as, for example, using screws or the like. This allows door 12 to be completely closed without an obstruction between the door operator apparatus and lintel 22. This arrangement further eases alignment relative the door top ledge for proper vertical placement on the door.

In the preferred form, motor assembly 14 includes a compact, low voltage, high rpm, and bi-directional electric motor. Such a compact high revving motors (about 5000 rpm) can generate an amount of power as similar to a much larger, high torque, low revving motors. The low voltage, preferably twenty four (24) volts DC or less, may be provided by a common transformer 24 (FIG. 1), and can simplify installation. A number of safety and/or building code are more stringent with regard high voltage devices and are less stringent with regard to the installation of low voltage devices. Accordingly, installation by a licensed technician may not be required or necessary, and the cost of installation may be reduced. Motor assembly 14 is preferably bi-directional so that a single motor may be utilized for both opening and closing door 12 under power. The bi-directional powered capability can be used to provide a door closer function.

Preferably, when the door operator is mounted on a door, power is supplied through a flexing wire 24' and/or power carrying hinge. The application of low voltage power is considerably safer, unlike a typical appliance voltage 120 volt that would present a greater shock hazard. This is also a concern if the door operator is to be mounted on a conductive metal door.

A gear assembly 25 is interposed between motor 14 and linkage device 16 to reduce the operating speed of the door. According to one embodiment, the speed reduction is approximately 840:1, as opposed an approximate 40:1 reduction for a low rpm motors of the prior art. Ideally, the final opening and closing rotational speed of a pivotal swinging door 12 is approximately 5–8 rpm.

Referring now to FIG. 3, an output shaft 15 of motor assembly 14 is coupled to a first gear train 26 of gear assembly 25, composed of several gear reductions (approximately 1:166). A clutch drive shaft 27 is rotatably coupled to a first gear train 26 at one end thereof while an opposite end is operably coupled to one side of clutch assembly 17. Similarly, a clutch pinion shaft 30 is rotatably coupled to an opposite side of clutch assembly 17 while the opposite end is coupled to a second gear train 31 of gear assembly 25. Pinion shaft 30 and clutch shaft 27 are co-axially mounted, each with an end rotatably supported by a bearing member 32, 32'.

A pinion gear 33 of second gear train 31 (FIG. 2) is intermeshed with a drive gear 34 mounted to a linkage drive shaft 35 which is rotatably supported at opposite ends to a pair of bearings 36, 36' for the final gear reduction (approximately 1:4).

FIGS. 1–3 illustrate that linkage drive shaft 35 drives linkage device 16 to power open or close door 12. Linkage device 16 includes a first arm 37 mounted to a splined end of linkage drive shaft 35 while an opposite end of first arm 37 is pivotally mounted to an end of a second arm 40. An opposite end of second arm 40 is pivotally mounted to a mounting bracket 41 formed to affix to either door lintel 22 (FIG. 2) when door operator 10 is mounted to door 12, or door 12 (FIG. 4) when door operator 10 is mounted to lintel 22. Further, linkage drive shaft 35 and first arm 37 can accommodate a variety of operational angles because there are no rotational stops within the mechanism. Any initial angle may be selected as long as the door close sensor 53 is calibrated and aligned to read the door as being closed when the door is actually closed.

As mentioned, torsional forces are transmitted from first gear train 26 to second gear train 31 through slip clutch assembly 17. Slippage of the clutch limits the torque transmission between the gears and the motor so as not to cause damage thereof in the event of an obstruction in the door path. Slippage of the clutch also permits manual operation. Moreover, this slippage also provides a buffering to protect the gears and motor, and thereby also permits the use gears that are smaller and/or inexpensive.

Similarly, to reduce the clutch size, slip clutch assembly 17 is interposed at an intermediate point within gear assembly 25 (i.e., between a first gear train 26 and a second gear train 31). Gear 31 reduces the rotational torque to a level that can be handled by a smaller and/or more compact clutch assembly. Additionally, the more complex first gear train 26 is shielded from extended wear and tear when door 12 is manually manipulated, due in part to the slippage. Ideally, the slip clutch would slip before transferring an excessive amount of torque generated from a manual operation of door 12, rather than causing the first gear train and the motor to receive the excessive amount of torque.

A controller unit 20 is coupled with motor assembly 14 and may be embodied within a circuit board with commonly known components. Preferably, controller unit 20 is coupled with a microprocessor and memory to support the operation of the door assembly apparatus.

Slip clutch assembly 17 typically includes at least two clutch plates 43 and 43' that are in frictionally engagement so that the rotational torque transmitted through first gear train 26 is transferred to the second gear train 31 to drive linkage drive shaft 35, and hence, linkage device 16. Frictionally engagement may also provide for a second rotational torque transmitted through second gear train 31 is transferred to the first gear train 26. The rotational torque and the second rotational torque may be comparable, or different depending. Clutch plates 43, 43' are typically designed to transfer a maximum amount of torque. An attempt to transfer torque in excessive of the maximum amount results in the slip clutch assembly slipping and transferring up the maximum amount of torque. Typically, the maximum amount of torque that may be transferred in one direction is similar to a second maximum amount of torque that may be transferred in the opposite direction. In one embodiment, the maximum amount of torque that may be transferred by the slip clutch assembly to the motor, based on manual operation of the door 12, is less than the maximum amount of torque that may be transferred by the motor to operate door 12.

While motor assembly 14 is normally powered through a low voltage transformer 24 (FIG. 1) plugged into a standard household outlet, rechargeable batteries 44 are preferably carried in housing 21 operably connected thereto to support continued operation in the event of a power failure.

In the preferred embodiment, controller unit 20 is controllable through a remote control (RC) unit selectively operated by the user to power open and/or power close the door through the door operator of the present invention. The remote control receiver is operably coupled to controller unit 20, and is preferably situated in housing 21. Whereas, a hand-held remote control transmitter may be carried by a user. Any type of transmission, such as, for example, radio, infrared or audio waves, can be employed as the communication medium. These types of transmitters and receivers are well known in the art. Further, it will be appreciated that wall mounted button(s) and/or weight sensitive pads could be coupled with the controller 20 to control the operation door operator apparatus.

A latching or locking mechanism 45 (FIG. 1) may be coupled with door 12. Preferably, door operator apparatus 10 cooperates with an unlatching device 47, commonly referred to in the industry as an electrical strike that selectively interacts with the latching mechanism 45 to operate door 12. Typically, the latching device is released just before the door is opened. Latching devices are well known in the art and are therefore not described in further detail herein. The present invention may also be used in conjunction with a portable unlatching device for enabling deadbolt and latch operation as disclosed in U.S. Pat. No. 5,095,654, which is incorporated by reference herein.

According to one embodiment, detection of the position of door 12 (whether in the opened position, unknown position, or closed position) may be determined with a door position sensor 53 as shown in FIG. 3. Sensor 53, in communication with controller unit 20, cooperates with linkage drive shaft 35 which rotates when door 12 is moved to between the opened position and closed position. Preferably, positioning sensor 53 includes wheel 54 which is affixed to the linkage drive shaft 35 that rotates about the longitudinal axis thereof during movement of door between the opened and closed position. A small magnet 56 is mounted to wheel 54 strategically positioned about its circumference. A magnet sensor 55, preferably an electronic magnetic detection device (solid state Hall Effect sensor), is fixed in a position near wheel 54 and become conductive as magnet 56 approaches sensor 55 during rotation of the wheel. In the preferred form, magnet 56 is positioned on wheel 54 such that when door 12 is in the closed position, magnet 56 is facing or in close proximity to sensor 55 to induce conduction therewith. Upon opening of the door, magnet 56 rotates out of proximity of magnet sensor 55 which is, subsequently, becomes non-conductive. This change of electrical state is detected by controller 20 indicating that door 12 has moved from the closed to open position.

Operation of the present invention in various modes will now be described.

Door 12 may be generally described in one of three positions, an open position, an unknown position, and a closed position. These three descriptive positions were chosen to generally discuss the operation of door 12 and door operator apparatus 10. A variety of different types of sensors can be utilized to provide positional information to door operator apparatus 10, as will be appreciated by one skilled in the art (such as, for example, current position, direction, speed, and/or timers in conjunction with activation/deactivation of the motor).

According to one embodiment, the closed position is sensed by a sensor coupled to the controller, and the unknown position is determined by sensing an obstruction or an event that may be sensed during the normal operation. The open position can be sensed by the controller, which is coupled to a timer and the motor. The controller may activate the motor for a time interval, corresponding to the timer, and if no other events (such as, for example, an obstruction or a signal event) occur then the position of the door is in the open position. Accordingly, one embodiment can sense the door position using a single sensor that is capable of sensing the closed position.

Another embodiment, may define the current door position as a closed position, an active opening position, a waiting position, and an active closing position. Accordingly, the door may be sensed in the closed position, placed in the active opening position to bias the door toward the open position. If the door operator is obstructed or unobstructed then the door can transition to the waiting position. If the door is in a position other than the closed position, a signal or event may occur to change the position to the active closing position.

A variety of operating modes may also be used to generally describe the operation of the door operator apparatus 10, including: 1) manual mode, 2) manual with assisted closing mode, 3) manual with assisted opening mode, 4) wait mode, 5) active remote mode, 6) obstructed mode, 7) unknown mode, and 8) combinations thereof.

Manual mode operations will now be described.

Manual mode allows manual operation of the door, such as, for example, manually opening and/or manually closing door 12. Generally, the manual mode may be described as mimicking a door biased to remain in a current position. In the manual mode, door 12 may be manually moved using a force that causes the slip clutch assembly to slip. The manual force required to open and/or close the door is at least slightly greater than a normal amount of force that would typically be used to open and/or close a similar door without an attached door operator apparatus. The amount of additional manual force is necessary to operate the door, and the additional manual force is a function of the force required to make the slip clutch assembly slip, and the slip clutch assembly's placement within in the door operator apparatus.

A variety of different slip clutches having a varying strengths may be utilized, and a given slip clutch may be adjusted to increase/decrease the maximum amount of transferred torque. In a preferred embodiment, the slip clutch is placed between the motor assembly and a final gear reduction that may be coupled to the linkage device 16.

An unbiased door may require as little as one half pound of force to open and/or close the door. A similar door coupled with a door operator apparatus, may require as little as about one pound of force to about twenty five pounds of force to open and/or close the door, and to cause the slip clutch to slip.

In a preferred embodiment, the amount of torque (or strength) of the slip clutch allows manual operation of door 12 with a minimal amount of additional force in excess of typical amount of force required to operate the door unencumbered by the door operator apparatus. The door operator enables manual operation of door 12 without regard to the mode of operation. Accordingly, the door operator apparatus does not prevent the utilization of the door. More importantly, a variety of conceivable malfunctions (such as, for example, a power outage or a fire) do not unnecessarily interfere with the manual operation of door 12.

Manual with assisted closing mode operations will now be described.

While door 12 is in the closed position 616, the manual operation with assisted closing mode biases the door toward the closed position in response to a manual opening of the closed door. Generally, the manual with assisted closing mode may be described as mimicking a passive spring door closer. Accordingly, if the door is in the closed position at 616 and a manual movement of door 12 is determined at 670 then motor is activated at 674 to bias door 12 toward the closed position. If an event occurs after the motor is activated at 674 then the door operator apparatus 10 may switch to a different mode of operation at 612. As illustrated, if an obstruction event and/or signal received event occurs then the process will transition to process that event at 650. Assuming no event is determined at 676, then the door will presumably be opened at 678 using enough force that causes the slip clutch assembly to slip. Motor assembly 14 remains engaged at 678 to bias the door toward the closed position.

The door operator apparatus may further includes a capability to determine movement of the door 12 by the controller 20 irrespective of the mode of operation. If movement of the door 12 is determined in the manual with assisted closing mode, then the controller responds by activating the motor assembly 14 to bias the door 12 toward the closed position. Accordingly, a door in the closed position can be manually opened by the application of a force that overcomes the resistance of the slip clutch assembly, causing the slip clutch assembly to slip. Once the force exerted on the door is released, the door is biased toward the closed position.

While door 12 is in the open position at 610, the manual with assisted closing mode at 620 maintains the activation or activates the motor assembly at 622 to bias door 12 toward the closed position. If an event occurs at 624 after the motor is activated (or remains activated) at 622 then the door operator apparatus 10 may switch to a different mode of operation at 612. As illustrated, if an obstruction event and/or signal event occurs at 624 then the process will transition to process the event at 650. Assuming no event is determined at 624, then the door will presumably be closed at 628. Ideally, a sensor (such as, for example, sensor 53) is used to determine when the door is in the closed position at 626. While in the closed position, the slip clutch remains engaged to bias door 12 in the present position and the motor is turned off at 628.

In one embodiment, the manual with assisted closing mode may be initiated, based in part, on applicable fire codes that may require closure of doors not being used. Moreover, in emergency situations, the automatic closing mode could be automatically activated in response to one or a number of warning alarms, such as burglary, fire and smoke alarms. The updated mode may be communicated to the door operator apparatus through wired or wireless communications operably coupled to controller unit 20.

Manual with assisted opening mode operations will now be described.

While door 12 is in the closed position 616, the manual operation with assisted opening mode biases the door toward the open position in response to a manual opening of door 12 from a closed position. Accordingly, if the door is in the closed position at 616 and a manual movement of door 12 is determined at 670 then motor 14 is activated at 684 (as indicated by the dashed line) to bias door 12 toward the open position. Additional processing would coincide with that of the automatic operation, as discussed below.

Wait mode operations will now be described.

A wait period may be initiated, such as, for example at 689, with the wait period being evaluated at 642 to determine if the determined duration of time has lapsed. If the wait period has lapsed then a corresponding wait completed event may be generated.

While door 12 is in the open position at 610, and a wait period may lapse and trigger a wait completed event. For example, the wait completed event, may correspond to the wait period set at 689, that is preferably processed in an automatic operation mode with the door in the open position at 610 and the wait completed event at 630, to cause the door 12 to be biased toward the closed position. According to one embodiment, the door 12 would remain in an open position for a duration of time, corresponding to the wait period, after the wait period has lapsed the motor would be activated to bias the door toward the closed position. A wide variety of approaches for implementing one or more wait modes will be appreciated by one skilled in the art.

Active remote mode operations will now be described.

The active remote mode typically correlates a remote command with an event. A remote control device is capable of transmitting one or more signals to a receiver coupled with the door operator apparatus. Each signal may generally indicate an intended operation of the door operator apparatus based in part on the movement of door 12, previous operation, current position, and current modes of door 12, the specific type of signal received, or a combination. Preferably, the signal receive generally indicates a remote event to be evaluated by the controller of the door operator apparatus.

While door 12 is in the closed position 616, the active remote mode can respond to receiving a signal at 680 by activating motor assembly 14 at 684 to bias door 12 toward the open position. Accordingly, if the door is in the closed position at 616 and a signal is received at 680 then motor assembly 14 is activated at 684 to bias door 12 toward the open position. If an event occurs after the motor is activated at 684 then the door operator apparatus 10 may switch to a different mode of operation. As illustrated, if an obstruction event and/or signal received event is determined after the motor assembly is activated and before door 12 is moved to the open position then the process can transition to process the event at 650. Assuming no event is determined at 686, then the door will presumably be moved to the open position at 688 and motor assembly 14 is turned off at 688. Ideally, the motor assembly is engaged for a predetermined length of time, which is typically sufficient to move the door to the open position. A waiting period may be initiated at 689 to correspond with another event (such as, for example, an expiration event) that may signal the door should be closed at the expiration of the waiting period.

Ideally, the door 12 is biased toward the closed position before biasing the door 12 toward the open position. Accordingly, the motor assembly 14 is activated to bias door 12 closed at 682, for an abbreviated period of time, prior to activating motor assembly 14 to bias door 12 toward the open position. This step can actually provide a smoother door operation. For example, door 12 may be coupled with an electric door strike, which are typically known to operate efficiently if the door is not biased open. Accordingly, biasing door 12 toward the closed position can promote a more efficient operation of the door strike. In another example, door 12 may be coupled with a door seal coupled within the doorframe structure 11 such that biasing door 12 toward the closed position disturbs the door seal. Accordingly, door 12 may be more easily opened with an initial closure and subsequent opening.

While door 12 is in the open position at 610, the active remote mode may process a signal at 630 to activate motor assembly 14 at 632 to bias door 12 toward the closed position. If an event occurs after the motor is activated (or remains activated) at 632 then the door operator apparatus 10 may switch to a different mode of operation. As illustrated, if an obstruction event and/or signal received event occurs at 634 then the process can transition to process the event at 650. Assuming no event is determined at 634, then the door will presumably be closed at 636 and the motor will be turned off at 636. Ideally, a sensor is used to determine when the door is in the closed position at 636. While in the closed position, the slip clutch remains engaged to bias door 12 in the closed position.

In the active remote mode, the door operator apparatus is capable of receiving and responding to one or more signal. According to one embodiment, any number of first signals may be received the door operator apparatus to control the operation of door 12. For example, three different signals may be received including a door open signal, a stop signal, and a door close signal. Preferably, a number of similar signal are received over a duration of time, with the response determined in part by the current position and/or the previous operation of the door. If the door 12 is closed, the first signal received may open the door, a second signal received after the door is in the open position to bias door 12 in the open position for an indeterminate duration, a third signal received may close the door, and fourth signal received during the door closing to stop the door. Alternatively, a second signal may be received while the door is opening to bias door 12 in the unknown position (here a partially open position) for an indeterminate duration. A variety of combinations will be appreciated by one skilled in the art. Typically, the operation of the door will be predetermined.

Obstructed mode operations will now be described.

An obstructed mode indicates an obstruction may exist. The obstruction may represent a user of door 12 being caught in the doors path, or a variety of other potential obstructions. According to one embodiment, the door operator apparatus can sense obstructions in the door pathway that prevent or obstruct biased movement of door 12 to the opened position or the closed position. According to one embodiment, door operator 10 includes an obstruction detection device in the form of a electric current sensor operably coupled to motor assembly to sense electronic current fluctuations. These fluctuations can be evaluated to identify unusual or unanticipated strains on the motor assembly that typically corresponds with an obstruction to a normal operating characteristic of the door operator apparatus. A variety of sensors and analysis may be used to detect an obstruction. One embodiment provides that as motor assembly 14 strains or struggles to overcome the obstruction, the current drawn by the motor assembly increases. Accordingly, the detection of motor current increase in excess of a normal amount and/or an excess amount over a duration of time indicates an obstruction. A determined obstruction, may be handled in a similar approach to the unknown mode, as described below.

Unknown mode operations will now be described.

Door 12 may be in an unknown position based on an operation causing a transfer to the connector at 612, based on, for example, a receive signal and/or an obstruction. The connector at 612 can indicate, for example, that an obstruction was sensed. A variety of different responses by the door operator apparatus may be performed while processing the event at 650. The unknown mode is described in more detail below with a combination of modes.

Combination of mode operations will now be described.

A combination of operating modes may be active at a given point in time. For example, the manual mode and the active remote mode may both be active. Accordingly, the door may be manually operated in the manual mode, and if a signal is received then the door may be activated to operate the door. Some modes are not combined, such as, for example, the manual with active closing mode and the manual with assisted opening mode. One skilled in the art will appreciate that a wide variety of combinations are useful to operate the door. One skilled in the art will also appreciate that a variety of functions described with respect to one or more of operation are functions that may be applicable to a variety of other modes of operation. Preferably, if controller unit 20 is operating according to more than one mode, the modes are prioritized to help determine an appropriate action to take in response to any of the potential events.

While door 12 is in an unknown position at 614, a response from the door operator apparatus may be based on a variety of available information. Several examples of available information includes: previous mode of operation, previous event received, previous attempted operation, current/past sensor information, number of attempts to move door 12 to an open and/or closed position, and any combination thereof. Normally, door 12 will be maintained in either the open position or the closed position. Unfortunately, a variety of potential event may occur and require processing at 650. In operation of the door, the controller may selectively respond to a subset of events that are related to a selected type of operation. Several examples are provided below to illustrate how an unknown mode may be handled in conjunction with another mode of operation.

A combination of a manual mode and unknown mode may occur when the door is moved, but not fully opened or fully closed. Typical, a manual mode operation biases the door 12 in the current position, such as the current unknown position, the open position, or the closed position. If controller 20 operates in a manual mode only, then events corresponding with obstructions, timers, and remote signals may be ignored.

A combination of a manual with active closing mode and unknown mode may occur during the movement of the door, such as, for example, with the occurrence of a detected obstruction, or an event. The event may include a lapsed signal associated with the expiration of a time period, or receiving another signal.

A combination of a manual with assisted opening mode and unknown mode may occur during an assisted opening of the door, such as, for example, with the occurrence of a detected obstruction, or an event.

A combination of a wait mode and unknown mode may occur after an event occurs, such as, for example, an obstruction. Accordingly, controller unit 20 may set a timer to delay any assisted door movement to allow the obstruction to be removed. A lapsed signal may be associated with the expiration of the timer to initiate a change in mode(s) of operation. The change in mode may be based, in part, on the previous modes of operation, current sensors, and the previous activities.

A combination of an active remote mode and an unknown mode may occur after an event occurs, such as, for example, an obstruction, a timeout event, or a received signal. A first signal may have been received to bias the door from the closed position toward the open position. If prior to door 12 reaching the open position a second signal is received then the controller unit 20 may ignore the second signal, disengage the motor, pause operation of the door and then bias door 12 toward the closed position. Preferably, the controller unit 20 will pause operation of the door, and change the mode of operation to include a wait mode and initiate a timer. If a third signal is received prior to the expiration of timer then the controller unit 20 may engage the motor to bias door 12 toward the open position or the closed position. Preferably, controller unit 20 will bias the door toward the closed position in response to the third signal. Alternative the third signal may represent a desire a transition to another mode, such as the manual mode. Preferably, a quick double signal (or two signals that are received within a short time interval) may prompt controller unit 20 to transition to the manual mode, thereby biasing door 12 in the present position.

A combination of an obstructed mode and an unknown mode may occur with the identification of an obstruction. Preferably, the motor is disengaged and would remain disengaged until the position of the door transitions to either the open position or the closed position. Sensors may be used to identify the position of the door and remove the obstructed mode and the unknown mode from the current operating modes. Accordingly, door 12 may return to the previous mode(s) of operation before the occurrence of the obstructed mode and unknown mode combination. Preferably, the door is manually moved to the closed position, which can be determined by controller unit 20.

According to one embodiment, the controller is configured to engage and/or disengage the motor in response to a subset of signals and events, received or determined. For example, if the door operator apparatus operates a publicly accessible door it is conceivable that a child may attempt to control the door by obstructing the door movement and/or repeatedly activating a remote device to remotely generate a signal. Accordingly, the controller may store the current operating mode(s) and transition to a taper resistant mode for a limited duration of time (such as, for example, 5 minutes). The taper resistant mode may be a manual operation only mode for the limited duration of time, such that the stored operating mode(s) are restored after the limited duration of time has lapsed.

Various inputs may be coupled with the controller unit 20 to adjust and/or setup the controllers' functionality. Several example approaches include the use of analog devices (such as, for example, potentiometer), digital devices (such as, for example, dip switches), timers, and receiving devices (such as, for example, an infrared receiver). A variety of different types of inputs can be utilized, as will be appreciated by one skilled in the art.

Accordingly, to coordinate a delay in operation, the controller unit of the present invention includes at least one timer, generating time intervals, to control the starting, stopping and duration of operation of motor assembly 14, unlatching device 47, clutch assembly 17 (such as, for example, adjusting the maximum amount of transferable torque), relative to the activation of the unit by the user. Briefly, for example, upon selective powered opening of door 12 from the closed position to the opened position, controller 20 engages the motor assembly to bias the door 12 closed for a predetermined time interval T1, after initial activation of operator 10 user, to allow unlatching device 47 to completely release door latching mechanism 45 before commencement of powered opening of door 12. Controller 20 is coupled with an easily accessible timer that is adjustable by potentiometer 50. This delay period or predetermined time interval t1 is adjustable from, for example, 0–5 seconds to accommodate a variety of latching devices.

In still another application, and in accordance with the present invention, the accurate positioning of door 12 in the opened position, relative the closed position, is governed through another timer to control the duration of time T2 which motor assembly 14 is in operation. Calculating the accurate positioning of the door as a function of motor operation time T2 (since the motor speed is substantially constant) is preferable to the mechanical adjustments or switches employed in the prior art to precalculate the opening angle relative to a reference point assuming a hinge mounted door and the opening width of a sliding door. These mechanical devices subject to wear and are not easily adjustable. Each time the user desires to change or alter the opening angle, and/or the door operator requires remounting to another door, these mechanical settings must be internally reset which is time consuming and laborious.

According to one embodiment, the opening angle may be increased by simply increasing the duration the motor assembly is operated, while a smaller operational duration yields a smaller angle. Similar to the other times, a variable adjustment, such as a potentiometer 50', is provided to control the motor operation time, and hence, the opening angle. Due to the relatively constant rotational speed of the motor assembly, the opening angle can easily be adjusted through manual manipulation of this adjustment. Hence, a plurality of door opening angles are provided simply by varying the variable timer.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suitable to the particular use contemplated. It is intended that the scope of the invention be defined by the claims appended hereto and their equivalents.

What is claimed is:

1. A remotely controllable door operator apparatus mountable between a door frame structure and a movable door to control door movement between a closed position and an opened position, said operator apparatus comprising:

a motor assembly having, an output shaft, said motor mountable to one of the door and the door frame structure;

a linkage device mountable to either the door or the door frame structure to control movement of the door;

a slip clutch assembly coupled between said output shaft and said linkage device to transfer torque therebetween, said slip clutch assembly slippably operable to enable manual operation of the door, and to enable remote operation of said door otherwise; and a controller unit coupled to said motor assembly to activate said operator apparatus to close the door in manual operation, and to control remote operation of said door operator apparatus to open and to close said door in response to at least one remotely generated signal.

2. The apparatus of claim 1, further comprising:

means for identifying a mounting of said door operator apparatus to the door as being one of a right hand door mount and a left hand door mount, said means for determining a mounting coupled with said controller unit to activate said door operator as a function of said mounting.

3. The apparatus of claim 1, further comprising:

means for sensing a position of the door, said means for sensing coupled to said controller unit, said position selected from positions consisting of: an open position, a closed position, and an unknown position.

4. The apparatus of claim 3, further comprising:

means for sensing said manual operation, said means for sensing coupled to said controller unit, wherein when said manual operation is determined said controller unit activates said motor assembly to bias the door toward the closed position, and when said position is said closed position said controller unit deactivates said motor assembly.

5. The apparatus of claim 4, further comprising:

means for timing said motor assembly, said means for timing coupled with said controller unit, wherein said controller unit deactivates said motor assembly in response to an activation of said motor assembly for a period of time in excess of a maximum time interval.

6. The apparatus of claim 5, wherein said maximum time interval is an interval of about five seconds to about forty seconds.

7. The apparatus of claim 3, further comprising:

means for sensing an obstruction to movement of the door, said means for sensing coupled to said controller unit, wherein said controller unit deactivates said motor assembly and when said obstruction is sensed said position is said unknown position.

8. The apparatus of claim 7, wherein means for identifying said obstruction is coupled with said motor assembly, and said obstruction is identified by monitoring at least one performance characteristic of said motor assembly.

9. The apparatus of claim 7, further comprising:

means for adjusting obstruction sensitivity coupled to said means for identifying said obstruction.

10. The apparatus of claim 3, further comprising:

means for receiving at least one signal by said controller unit to initiate said remote operation, wherein said controller unit activates said motor assembly to bias the door toward the open position when said position is said closed position and a first signal, selected from said at least one signal, is received.

11. The apparatus of claim 10, further comprising:

means for timing said motor assembly, said means for timing coupled with said controller unit, wherein said controller unit deactivates said motor assembly and said position is said open position, in response to an activation of said motor assembly for a first period of time.

12. The apparatus of claim 11, further comprising:

means for sensing a door open position, said means for sensing coupled with said controller unit, wherein said controller unit deactivates said motor assembly and position is said open position, in response to identifying said door open position.

13. The apparatus of claim 10, wherein said controller unit activates said motor assembly to bias the door toward the closed position before said controller unit activates said motor assembly to bias the door toward the open position.

14. The apparatus of claim 7, further comprising:

means for timing said motor assembly, said means for timing coupled with said controller unit, wherein said controller unit deactivates said motor assembly and sets said position to said unknown position, in response to an activation of said motor assembly for a period of time in excess of a maximum time interval.

15. The apparatus of claim 7, further comprising:

means for identifying an obstruction to the door, said means for identifying coupled to said controller unit, wherein said controller unit deactivates said motor assembly and sets said position to said unknown position when said obstruction is identified.

16. The apparatus of claim 15, wherein said means for identifying said obstruction is coupled with said motor assembly, and said obstruction is identified by monitoring at least one performance characteristic of said motor assembly.

17. The apparatus of claim 7, wherein said controller unit deactivates said motor assembly to bias the door in a current position if a second signal, selected from said at least one signal, is received by said means for receiving.

18. The apparatus of claim 7, wherein said controller unit deactivates said motor assembly to bias the door in a current position if a second signal, selected from said at least one signal, is received by said means for receiving when said position is one of said unknown position and said open position.

19. The apparatus of claim 1, wherein said slip clutch is a clutch selected from a set of clutches comprising: a mechanical clutch, an electronic clutch, and an electromechanical clutch.

20. The apparatus of claim 1, further comprising a power supply to supply a low voltage to operate said door operator apparatus.

21. The apparatus of claim 1, wherein said controller activates said motor assembly for a predetermined period of time to close the door in manual operation.

22. The apparatus of claim 1, wherein said controller activates said motor assembly for a predetermined period of time to open the door in manual operation.

23. A door operator apparatus mountable to a door frame structure and a movable door to control movement between a closed position and an opened position, said operator apparatus remotely controllable, said operator apparatus comprising:

a motor assembly having an output shaft, said motor mountable to one of the door and the door frame structure;

a rotation reduction assembly including a first input shaft and a reduced second output shaft;

a linkage device coupled to said reduced second output shaft, said linkage device mountable to either the door or the door frame structure to control movement of the door;

a slip clutch assembly coupled between said output shaft and said first input shaft to transfer torque therebetween, to enable a manual operation of the door by causing said clutch assembly to slip, and to enable a remote operation of the door; and a controller unit coupled to said motor assembly to activate said operator apparatus to close the door in manual operation, and to control remote operation of said door operator apparatus to open and to close said door in response to at least one remote signal.

24. A method of remotely controlling a door using a door operator including a motor assembly having an output shaft, said motor mountable to one of the door and the door frame structure, and a linkage device mountable to either the door or the door frame the door frame structure to control movement of the door, a slip clutch assembly coupled between said output shaft and said linkage device to transfer torque therebetween, said method comprising:

mounting the door operator apparatus between a door frame structure and a movable door to control door movement between a closed position and an opened position;

sensing a position of the door from positions consisting of: a closed position, an open position, and an unknown position;

receiving at least one remotely generated signal;

enabling and disabling a remote operation of the door;

evaluating a received signal, said position, and said enabling said remote operation using a controller unit coupled to said motor assembly to activate said motor to open and to close said door; and enabling a manual operation of the door with the application of a manual force applied to the door and causing a slip clutch assembly to slip.

25. The apparatus of claim 1, wherein said slip clutch is field adjustable to increase or decrease the transfer torque.

26. The apparatus of claim 25, wherein said slip clutch includes a mechanical adjustment to increase or decrease the transfer torque.

27. The apparatus of claim 25, wherein said slip clutch includes a mechanical adjustment to adjust said slip clutch after said apparatus is mounted between the door frame structure and the movable door.

28. The apparatus of claim 25, wherein said slip clutch includes a mechanical adjustment capable of adjusting said slip clutch during maintenance without un-mounting the apparatus.

29. The apparatus of claim 25, wherein said transfer torque is adjustable to allow operation of said door within a door operating environment.

30. The apparatus of claim 29, wherein said door operating environment is an environment selected from a set of environments comprising: an indoor environment, and an outdoor environment.

31. The apparatus of claim 30, wherein said slip clutch is capable of a field adjustment to increase the transfer torque in said outdoor environment during installation, and said slip clutch is capable of the field adjustment to decrease the transfer torque in said indoor environment during installation.

32. The apparatus of claim 30, wherein slip clutch is capable of a field adjustment to increase the transfer torque in said outdoor environment during a period of high winds and adjusted to decrease the transfer torque in said outdoor environment after said period of high winds.

33. The apparatus of claim 25, wherein said linkage device includes a linkage drive shaft and a second linkage device, said linkage drive shaft coupled with said slip clutch and said second linkage device, said second linkage device mountable to said either the door or the door frame structure.

34. The apparatus of claim 33, wherein the torque transferred by said slip clutch is transferred to said linkage drive shaft.

35. The apparatus of claim 34, wherein a rotational speed of said linkage drive shaft is about the same as the rotational speed of the slip clutch assembly coupled with said linkage device.

36. The apparatus of claim 25, wherein said apparatus includes one reduction gear set, said reduction gear set coupled between said motor assembly and said slip clutch assembly to reduce rotational speed of said output shaft.

37. The apparatus of claim 25, wherein said motor assembly includes one reduction gear set, said reduction gear set coupled between said motor and said output shaft.

38. The apparatus of claim 36, wherein said linkage device includes a second reduction gear set, said second reduction gear set coupled between said slip clutch assembly and said door to reduce operational speed of said linkage device.

39. The apparatus of claim 1, wherein said slip clutch includes a field adjustment to increase the transfer torque for a first set of potential obstructions, and to decrease the transfer torque for a second set of potential obstructions otherwise.

40. The apparatus of claim 39, wherein said first set of potential obstructions includes obstructions encountered in an outdoor environment, and said second set of potential obstructions includes obstructions encountered in an indoor operating environment.

41. The apparatus of claim 40, wherein said field adjustment is field adjustable to increase the transfer torque for said outdoor environment, and to decrease the transfer torque for said indoor environment otherwise.

42. The apparatus of claim 39, wherein said second set of potential obstructions includes obstructions from at least one user, said user selected from a set of users comprising: child user, handicap user, and elderly user.

43. The apparatus of claim 1, wherein said slip clutch includes a field adjustment to increase or decrease the transfer torque.

44. The apparatus of claim 43, wherein said field adjustment is electronically adjustable.

45. The apparatus of claim 43, wherein said controller unit is coupled with said slip clutch to adjust said field adjustment.

46. The apparatus of claim 43, wherein said slip clutch is an electromechanical slip clutch.

47. The apparatus of claim 43, further comprising a potentiometer coupled with said controller unit, said controller unit capable of electronically adjusting the field adjustment as a function of a current position of said potentiometer.

48. The apparatus of claim 43, further comprising a potentiometer coupled with said controller unit, said controller unit capable of electronically setting the field adjustment as a function of a current position of said potentiometer.

49. The apparatus of claim 43, wherein said transfer torque is defined as a function of a current position of a potentiometer.

50. The apparatus of claim 43, further comprising a potentiometer coupled with said controller unit, said controller unit capable of defining said transfer torque.

51. The apparatus of claim 1, wherein said controller unit remote operation to open includes first to close said door and then to open said door.

52. The apparatus of claim 51, wherein said first to close said door is capable of being performed while the door is closed in the door frame structure.

53. The apparatus of claim 51, wherein said controller unit measures at least one performance characteristic of said motor assembly.

54. The apparatus of claim 53, wherein said controller unit is capable of identifying an obstruction by monitoring at least one performance characteristic of said motor assembly.

55. The apparatus of claim 54, wherein said controller unit deactivates said motor assembly when said obstruction is determined.

56. The apparatus of claim 51, wherein said controller unit measures at least one second performance characteristic of said motor assembly after an initial close.

57. The apparatus of claim 56, wherein said controller unit compares at least one performance characteristic of said motor assembly and said second performance characteristic to determine an obstruction.

58. The apparatus of claim 57, wherein said controller unit deactivates said motor assembly when said obstruction is determined.

* * * * *